United States Patent [19]

Gyöngyös et al.

[11] 4,217,947

[45] Aug. 19, 1980

[54] PROCESS FOR THE DELIVERY OF MOLTEN METAL TO A CATERPILLAR TYPE MOLD

[75] Inventors: Ivan Gyöngyös, Männedorf; Martin Bolliger, Sierre, both of Switzerland

[73] Assignee: Prolizenz AG, Chur, Switzerland

[21] Appl. No.: 900,753

[22] Filed: Apr. 27, 1978

[30] Foreign Application Priority Data

May 5, 1977 [CH] Switzerland ..... 5622/77

[51] Int. Cl.[3] ..... B22D 11/10; B22D 11/06

[52] U.S. Cl. ..... 164/87; 164/430; 164/437

[58] Field of Search ..... 164/87, 88, 429, 430, 164/431, 432, 434, 437

[56] References Cited

U.S. PATENT DOCUMENTS

| | | | |
|---|---|---|---|
| 1,870,406 | 8/1932 | Douteur | 164/430 |
| 2,904,860 | 9/1959 | Hazalett | 164/87 |
| 2,978,761 | 4/1961 | Foye et al. | 164/431 |
| 3,036,348 | 5/1962 | Hazalett et al. | 164/431 X |
| 3,080,627 | 3/1963 | Hoteko | 164/434 X |
| 3,746,072 | 7/1973 | Richardson | 164/434 X |
| 3,774,670 | 11/1973 | Gyongyos | 164/430 |

*Primary Examiner*—Robert D. Baldwin
*Assistant Examiner*—Gus T. Hampilos
*Attorney, Agent, or Firm*—Bachman and LaPointe

[57] ABSTRACT

A process is described for the delivery of molten metal to a caterpillar type mold which is inclined slightly to the horizontal and is used for casting wide strip, especially non-ferromagnetic metals, such as aluminium of aluminium alloys. The metal is fed through a delivery nozzle made of fire resistant material to a head of liquid metal in the mold either under the free surface of this head of metal or through this free surface on the head of liquid metal. Premature contact with the mold wall is avoided and the molten metal is fed in an almost pressureless manner.

1 Claim, 5 Drawing Figures

10,22
12,24
39
40
34
35
36
37
38
22
24
33
12
10
15

PROCESS FOR THE DELIVERY OF MOLTEN METAL TO A CATERPILLAR TYPE MOLD

BACKGROUND OF THE INVENTION

In the continuous casting of ferrous and non-ferrous metals there has been developed caterpillar type molds in which the casting mold is formed by a double row of mold halves which are connected into a pair of endless circularly running chains. At the inlet end the mold halves, which are positioned opposite each other, lie against each other and move in such position over a certain distance over which they form the caterpillar type mold itself. The molds then separate and after a short time come together again at the inlet end.

Of the machines designed for casting aluminium and aluminium alloy plate or strip the one designed by the Hunter Douglas Corporation has been employed for some 20 years. In the Hunter Douglas caster the plate or strip is cast in the horizontal plane. The liquid is fed to the caster via a flat-shaped nozzle made of fire-resistant material. The fire-resistant material is made of a mixture of 30% long asbestos fibers, 20% sodium silicate (dry weight) and 28% chalk to form calcium silicate which is more heat resistant than the sodium silicate. The sodium silicate is added to the other components as water glass, to form a doughy mass which is shaped and then baked under slight pressure. The process for manufacturing this material is described in the U.S. Pat. No. 2,326,516.

More recently another caterpillar type caster for casting wide metal strip has become available. The machine casts in the horizontal plane or in a plane slightly inclined to the horizontal. A nozzle for feeding liquid metal to this machine is described in the Swiss Pat. CH-PS No. 508,433.

In order to transfer the molten metal to the mold when casting strip in caterpillar type molds which are horizontal or slightly inclined to the horizontal, known metal transfer nozzles which practically seal off the cross section of the mold must be under a certain metallostatic pressure from the trough. This is the case with the transfer nozzle in U.S. Pat. No. 2,752,649 and those nozzles in Swiss Pat. CH-PS No. 508,433 and U.S. Pat. No. 3,774,670.

Known methods employ flat nozzles in slightly inclined caterpillar type molds. The mold operates as a furnace dependent mold where the term furnace is to include all kinds of containers for the melt i.e. the trough. During casting the caterpillar type mold is always kept filled to where the nozzle tapers so that during casting no metal head with "free" surface forms on the nozzle.

The process of the present invention for the delivery of molten metal during the casting of wide strip non-ferromagnetic metals such as aluminum and aluminum alloys, copper and copper alloys, zinc and zinc alloys and magnesium and magnesium alloys, into a caterpillar type mold inclined at 3° to 30° to the horizontal via a nozzle made of fire resistant material is such that the molten metal is led into a head of liquid metal in the mold and under the surface of the metal and in such a way as to avoid premature contact with the wall of the moving mold halves and so as to reach the wall of the mold through this metal head without almost any overpressure.

In contrast to the mode of operation used heretofore, in the process of the present invention a metal head with free metal surface as in DC casting is produced at the pouring end of the delivery nozzle. The caterpillar type mold inclined to the horizontal is used therefore, in terms of the present invention, as a furnace dependent mould. The metal head with free metal surface forms in the mold which is closed off at the start of casting by a dummy or starting ingot which is drawn out of the mold during casting after the head of metal has formed.

In known furnace dependent caterpillar type molds which are horizontal or lie at an acute angle of for example 1° to 30° to the horizontal, there is a free metal surface only in the trough but not in the mould itself.

Extensive trials by the inventor have shown that the metallostatic pressure in the caterpillar type caster inclined slightly to the horizontal can be detrimental on casting pure grades of aluminium using the practice employed to date which permits a free metal surface only in the trough thereby resulting in a, fast rate of cooling, one would not normally expect due to the temperature condition. It is preferred that the initial rate of solidification not be too fast.

Metal transfer without metallostatic pressure, as in the process of the present invention, causes the solidifying melt to exert less pressure on the surface of the mold which results in a lower rate of solidification at the start of casting. When rapidly cooled a metal crust form which exhibits stresses which cause buckling and consequently localised lifting away from the surface of the mold. At the places where the crust has lifted away cavities and pronounced porosity form in the cast strip.

The rate of solidification can be determined metallographically by measuring the fineness of the cellular structure.

In caterpillar type casters with mold halves made of steel, during the casting of a hot aluminium melt of purity 99.2% at 680° to 700° C. the mold walls have a temperature of, for example, 105° to 115° C., and on casting with closed metal delivery nozzles, as is described in the Swiss Pat. CH-PS No. 508,433, a structure of cell size 5 to 30 μm is obtained up to a depth of approx. 0.3 mm below the outer skin. By using a closed nozzle the metallostatic pressure of the melt in the trough produces rapid cooling inside the mould thus causing the above mentioned disadvantages. If however the aluminum melt is allowed to flow from the trough to the mold without metallostatic pressure a structure of cell size 30 to 70 μm is obtained to a depth of about 0.3 mm below the skin as a result of the slower solidification rate thus avoiding the above mentioned disadvantages.

Heretofore, it was not known nor expected that the metallostatic pressure in a caterpillar type caster, inclined at an angle of for example 1° to 15° to the horizontal, had such a pronounced effect on the rate of initial solidification.

Similar results are obtained with aluminium of other grades of purity with aluminium alloys, and with other non-ferromagnetic metals such as magnesium, zinc, copper and their alloys.

Attempts were made to decrease the rate of cooling in caterpillar type casters by appliying a coating to the walls of the mold halves of materials of lower heat conductivity than steel such as chrome-nickel steel and grey cast iron. Also, to decrease the rate of cooling higher mold temperatures were employed. While these measures did lead to less rapid solidification they also led to surface flaws in the cast strip. These surface flaws were mainly due to bleeding.

For reasons of simplicity metal delivery without a metallostatic head may be characterized as "almost pressureless delivery". In the trials carried out it was found that such almost pressureless delivery not only markedly reduced the solidification stresses in the strip, which can lead to cracks, but also resulted in the surface of the strip having much less or even no surface bleeding. Such surface bleeding causes steakiness in the sheet after it has been hot rolled.

SUMMARY OF THE INVENTION

With the results of the above mentioned trials in mind, the inventor set himself the task of delivering the molten metal to the mold of an inclined caterpillar type caster not only almost without pressure but also in such a manner so as to prevent the molten metal from coming into contact prematurely with the walls of the moving mold halves. Premature contact with the mold walls would occur if the melt were to be poured into the mold like water in a stream.

It was found that the angle of inclination of the caterpillar type mold should not be too small. If the inclination is too small the free surface of metal in the mold would be too large and the heat of solidification would for the most part, be conducted away through the lower half of the mold. The bottom of the sump, i.e. the bottom of the liquid metal in the mold would thus be displaced upwards from the center of the strip (as viewed in a longitudinal cross section) so that assymetric solidification would occur over the strip thickness and would result in blisters gathering near the surface of the strip. Pronounced assymetric solidification can lead to difficulties in later stages of processing of the strip. For these reasons, the angle of inclination used in connection with almost pressureless metal delivery should not be less than 3°. Casting is in fact done preferrably at a much larger inclination e.g. at 10° to 15°. The process also yields good results at an inclination of 30°.

It has also been found that if the molten metal is simply allowed to flow into the mold as a river flows into the sea a more pronounced aluminum oxide layer is formed due to turbulence of the metal. This heavy oxide layer also finds its way into the mold, is caught by the mold wall and is detrimental to the surface and the interior of the strip. It was found that this thick oxide layer could be prevented from forming by delivering the molten metal to the mold under the surface of the liquid metal in the mold.

In carrying out the process of the present invention care must be taken to keep the level of the metal in the mold always at the same height during casting. This requirement can be met by maintaining a constant casting rate.

An approximately constant casting rate is achieved by feeding the molten metal to the mold via a channel of given cross section and forming a head of liquid metal there. The casting speed is controlled by measuring the height of the head of metal.

The delivery of the molten metal under the free surface of a head of molten metal in a caterpillar type mold inclined to the horizontal can be achieved in two ways, either directly under the metal surface or through the metal surface by means of the nozzle (bottom-pouring). In both cases this metal is delivered over the entire width of the strip being cast.

Both methods of metal delivery are illustrated in the drawings by examples of metal delivery devices. The drawings also show an example of a device for sensing the height of the free metal surface.

DETAILED DESCRIPTION

Figure 1:
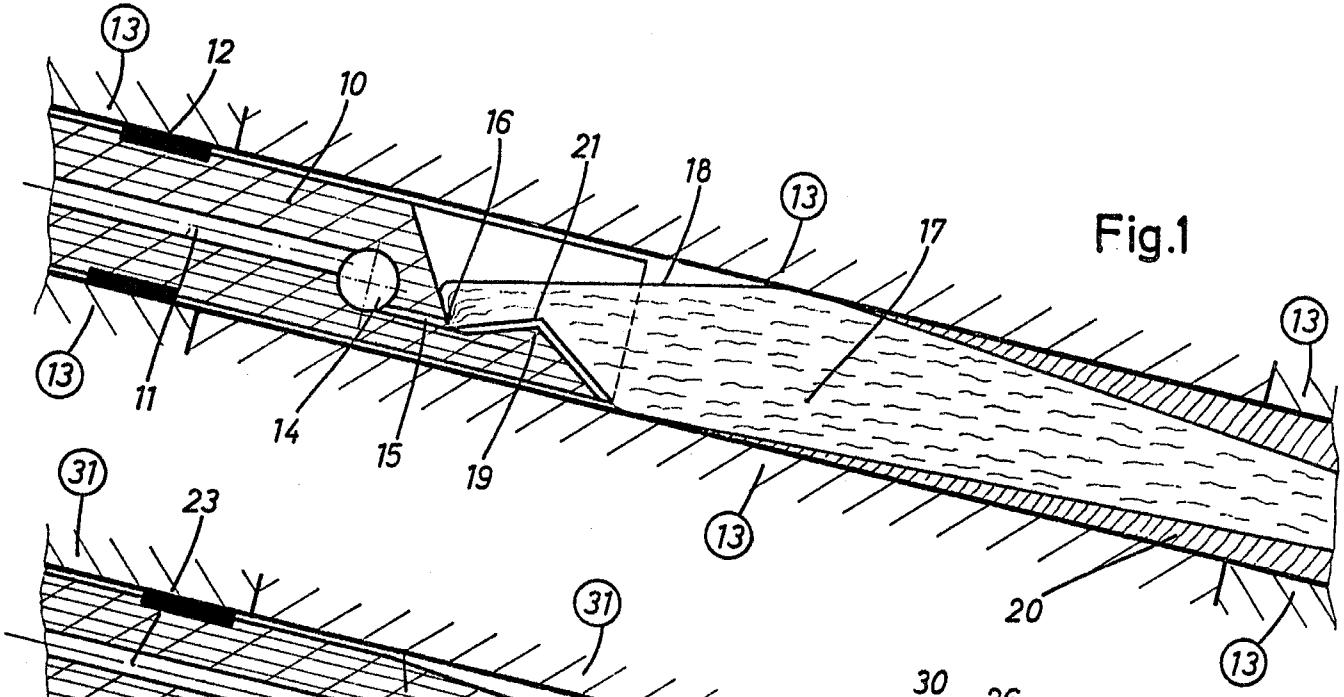
FIG. 1: Is a longitudinal cross section through a device for the delivery of an aluminium melt directly under the free surface of the liquid metal in the mold.

Referring to FIG. 1, the lower end of a flat delivery nozzle made of fire resistant asbestos fiber-silicate material is denoted by the numeral 1. The nozzle is connected to a delivery trough and has a plurality of feed channels 11 which are distributed across the whole breadth of the flat nozzle 10. The breadth of the nozzle corresponds in width to the width of the strip being cast. The support of the nozzle can correspond to that described in the Swiss Pat. CH-PS No. 508,433 or the U.S. Pat. No. 3,774,670. With large widths of strip it is useful to have the nozzle in the form of individual elements which combine to make a unit which extends across the whole width of the strip.

When casting strips of a width of 1500 mm three nozzles each 500 mm wide are secured to one fixture. Instead of three 500 mm wide nozzles one could also use six 250 mm wide nozzles and on casting 1000 mm wide strip five 200 mm wide nozzles, four 250 mm nozzles or two 500 mm wide nozzles could be used.

Spacers 12 in the form of graphite bearings prevent the nozzle 10 from coming into contact with the mold halves 13, which for reasons of simplicity are not shown in full here. In practice the aluminium melt reaches the mold halves via the delivery channels 11, first a transverse channel 14, which stretches over almost the whole width of the nozzle and serves as an equalizing space. From there the melt then reaches a broad slit 15 (which can be replaced by holes lying in the direction of casting and arranged in a row parallel to each other) and then the lead of metal 17 under the free surface 18. The nozzle 10 is provided with a raised part 19 so that the melt enters near the surface 18, i.e. in the upper part of the metal head. Thanks to this raised part 19 the molten metal entering the mold is distributed better in the head of liquid metal and does not disturb the formation of the lower solidification crust 20. In practice the free surface 18 should always be higher than the lip 21 on the raised part 19. The layer of aluminium oxide on the free surface 18 of the metal in the mold is not disturbed by the inflowing molten metal. The layer is caught by the wall of the upper mould halves 13 and offers almost no impairment to the upper surface of the strip. The lower surface of the strip takes no oxide with it. However, an oxide layer does form on the lower surface due to the influence of the oxygen in the air which can not be kept away from the raised part 19 and the wall of the lower mold halves, partly because of the lubricating layer which may be present on the mold wall.

If the delivery channels 11 are in the form of holes they are, for example, 8 mm in diameter for a nozzle used to cast 25 mm thick strip. The diameter of the transverse hole 14 is 14 mm and the height of the slit 15 is 4 mm.

Aluminium strips approx. 25 mm thick and 1000 mm wide casted using the device shown in FIG. 1, exhibited an excellent surface quality, even though the bottom face was not as excellent as the upper face, because of a very slight amount of bleeding.

Figure 2:
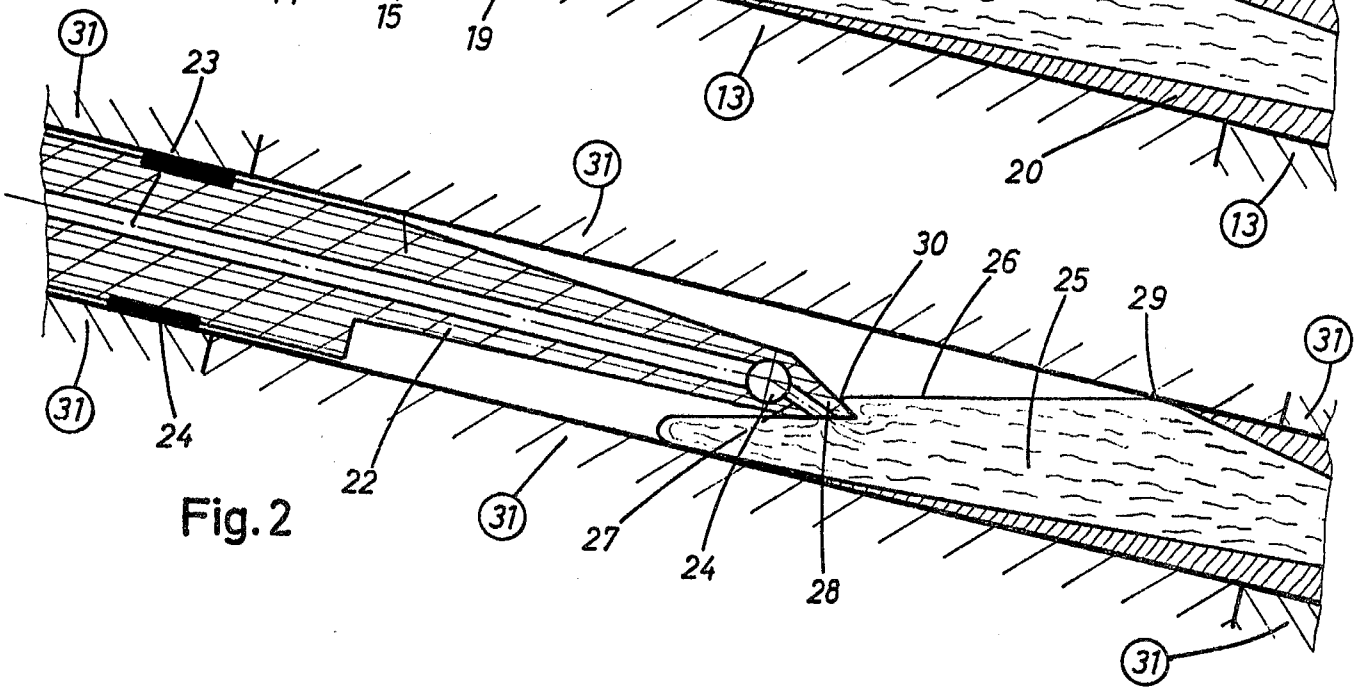
FIG. 2: Is a longitudinal cross section through a device for the delivery of the metal charge through the surface of the molten metal in the mold.

Whilst the nozzle shown in FIG. 1 allows the molten charge to flow into the head of liquid metal directly under the free surface of the metal in the mold, the nozzle shown in FIG. 2 allows the molten charge to be fed to the head of metal through the free surface of the head of metal in the mold.

FIG. 2 shows the lower end of a flat nozzle 22 which is made of a fire resistant material of asbestos fiber and silicate, and is connected to a trough, not shown. The nozzle 22 contains a plurality of feed channels 23, for example holes, which are distributed across almost the whole width of the nozzle 22. Again, it is useful when casting large widths to make the nozzle out of individual elements of smaller widths fitted together in a row to form one unit. Spacers 24 are provided in the form of graphite bearings. In practice the molten charge first flows through the feed channels 23 to reach the transverse hole 24 which extends over almost the whole width of the nozzle 22 and which serves as an equalizing space, before reaching the head of molten metal 25 under the free surface 26 via a broad slit 27 in the tapered tip 28 of the nozzle 22. A meniscus 29 forms around the whole of the free surface 26 of the molten metal in the mold 31 and another meniscus 30 forms around the tapered tip 28 of the nozzle 22. The slit 27 can be replaced by a series of holes which run parallel to each other similar to the slit 15 in the device shown in FIG. 1.

It was surprisingly found that the presence of the meniscus 29 on the mold surface of the lower mold halves 31 has a very favorable effect on the quality of the lower surface of the cast aluminum strip. While a full scientific explanation is not intended, it does appear that there is a causual relation between the meniscus on the wall of the lower mold half 31 and the quality of the lower face of the strip. It seems that in the device shown in FIG. 1, the transition between the outer lip of the raised part 19 and the wall of the lower mold half disturbs the metal flow.

Figures 3, 4, 5:
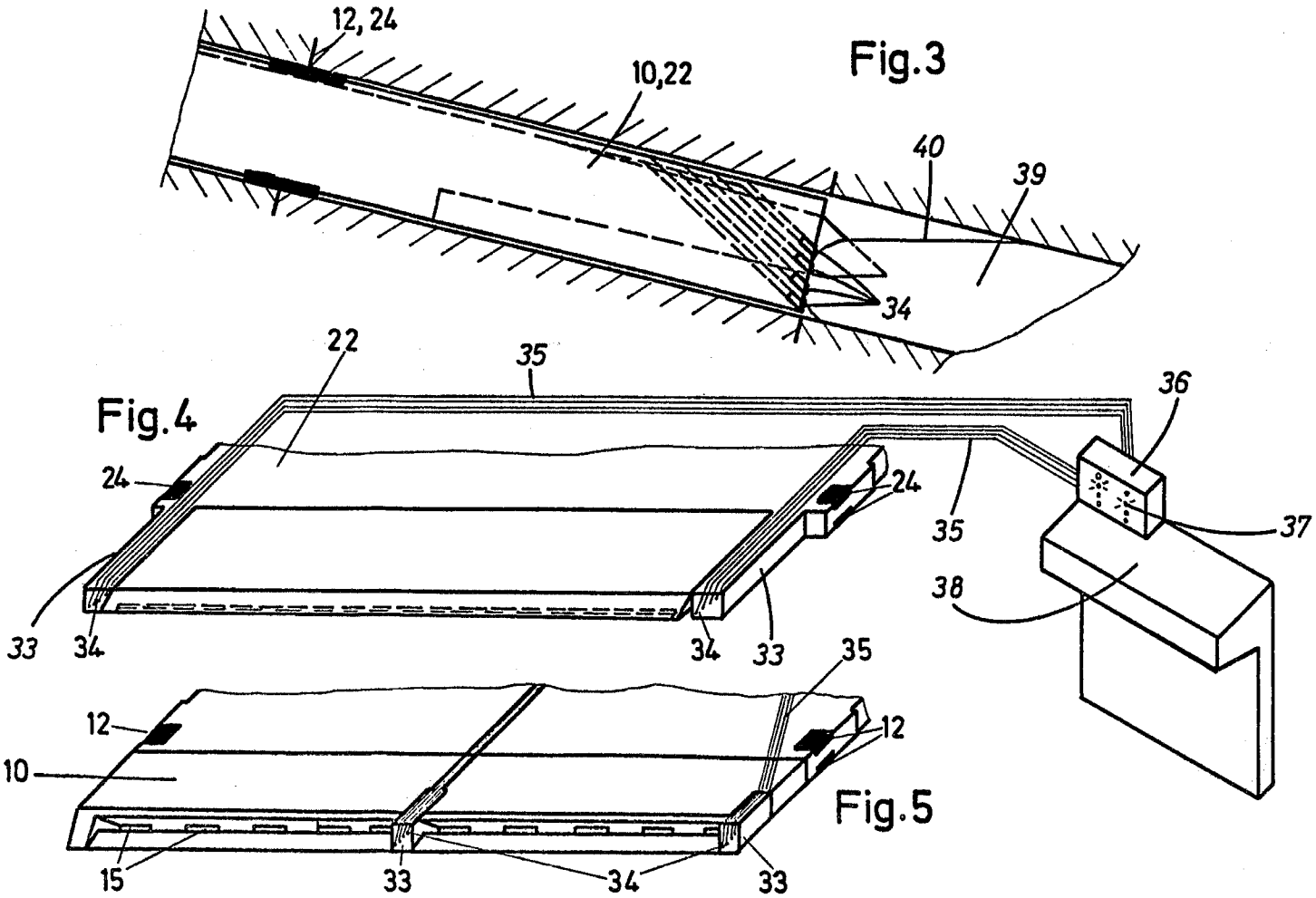
FIG. 3: Is a longitudinal cross section of a device for the delivery of a metal charge through the surface of the molten metal in the mold and with a sensing device to measure the height of the free metal surface.
FIG. 4: Is a perspective view of a device for determining the height of the free metal surface, together with control panel, the nozzle end corresponding to that shown in FIG. 2.
FIG. 5: Is a perspective view of a device for determining the height of the free metal surface, control panel not shown and the nozzle end corresponding to that shown in FIG. 1.

FIGS. 3, 4 and 5 indicate how four graphite sensors 34 are provided in the front end of the side edges 33 of a nozzle 10, 22 made of a fire resistant material of asbestos fibers and silicate. Electrical wires 35 are partly incorporated in the nozzle edges 33 and are connected to a control panel 36 which is provided with lights 37 and is mounted on a control desk 38. The wires are connected to a power source of, for example, 8 volts. By means of these graphite sensors 34, the electrical circuit is completed as soon as the free end of the graphite sensors comes into contact with the head 39 of liquid metal or its free surface 40. On closing the circuit light bulbs 37 on the control panel 36 light up and the height of the metal head 39 is indicated with an accuracy which depends on the distance between the graphite sensors. Therefore, the accuracy depends on the number of sensors. In the FIGS. 3 through 5, four graphite sensors 34 are provided on each long edge 33 of the nozzles. In FIG. 3 the metal head reaches the three lower graphite sensors on each side so that the three lower lights 37 for each side lights up on the control panel.

During the casting process, as illustrated in FIG. 3, the free surface 40 of the metal head 39 is maintained between both uppermost graphite sensors and the sensors immediately below them. If both uppermost lights 37 light up the head of metal must be lowered. This is best achieved by increasing the solidification rate by increasing the rate at which the mold halves move. If the free surface of the metal head falls too much, the pair of lights second from the top on the control panel 36 are extinguished as the electrical circuit containing the second top pair of graphite sensors is broken. To return to the prescribed level the casting rate must be decreased.

Sensors for determining the height of the lead of liquid metal can also be in the form of mini-mantle thermocouples.

The control panel can of course also be used to control the rate of casting automatically.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. A process for delivering molten metal into a caterpillar type mold for casting wide strips of non-ferromagnetic materials comprising:

inclining said caterpillar mold at an angle of from about 3° to 30° to the horizontal;

charging said mold with a head of liquid metal;

positioning a nozzle of fire-resistant material within said mold and proximate to said head of liquid metal so as to form a meniscus around said nozzle such that said molten metal is fed to said head of liquid metal under the free surface thereof whereby contact between said molten metal and the walls of said mold is delayed thereby reducing the initial rate of solidification of said molten metal; and providing the nozzle with a raised portion downstream of the outlet of said nozzle for elevating said molten metal to the top of said head of liquid metal.

* * * * *